United States Patent [19]

Herold

[11] 4,068,702

[45] Jan. 17, 1978

[54] METHOD FOR POSITIONING A STRONGBACK

[75] Inventor: Robert A. Herold, Tolland, Conn.

[73] Assignee: United Technologies Corporation, Hartford, Conn.

[21] Appl. No.: 722,181

[22] Filed: Sept. 10, 1976

[51] Int. Cl.[2] ..... B22C 9/10; B22C 7/02

[52] U.S. Cl. ..... 164/30; 164/35; 164/60; 164/235; 164/246

[58] Field of Search ..... 164/30, 34, 35, 36, 164/43, 60, 165, 166, 361, 365, 366; 249/125

[56] References Cited

U.S. PATENT DOCUMENTS 3,648,760 3/1972 Cooper ..... 164/35 X

*Primary Examiner*—Francis S. Husar
*Assistant Examiner*—John S. Brown
*Attorney, Agent, or Firm*—Edward J. Timmer

[57] ABSTRACT

The present invention provides a method for improved positioning of a strongback in a pattern mold for formation of expendable patterns thereon. Investment casting molds formed around the assembly of strongback and patterns are characterized as having the strongback precisely and reproducibly suspended therein. Articles, such as turbine blade halves, cast in such investment molds have mating surfaces in close dimensional relationship and can be bonded one to any mating other to form a finished product.

In particular, improved positioning of the strongback in the pattern mold is achieved by suspending the strongback from the bonding locators by expendable locating means; that is, locating means which are incorporated into the patterns formed on the strongback surfaces. The use of expendable locating means enables the bonding locators to also serve as locators for positioning the strongback in the pattern mold and essentially eliminates errors in strongback positioning due to tolerances associated therewith.

5 Claims, 8 Drawing Figures

FIG. 1
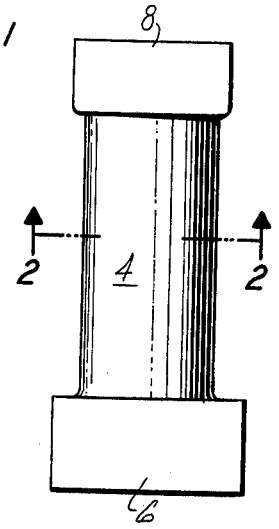
FIG. 2
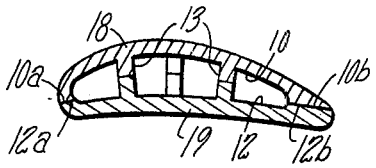
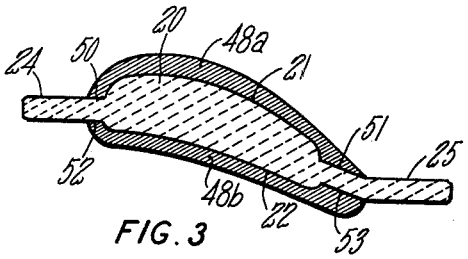
FIG. 3
FIG. 4
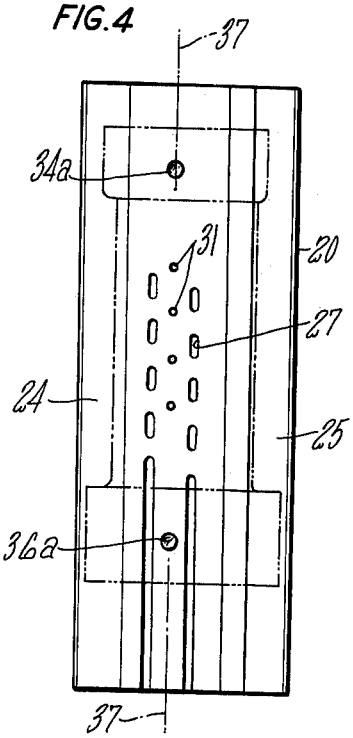
FIG. 5
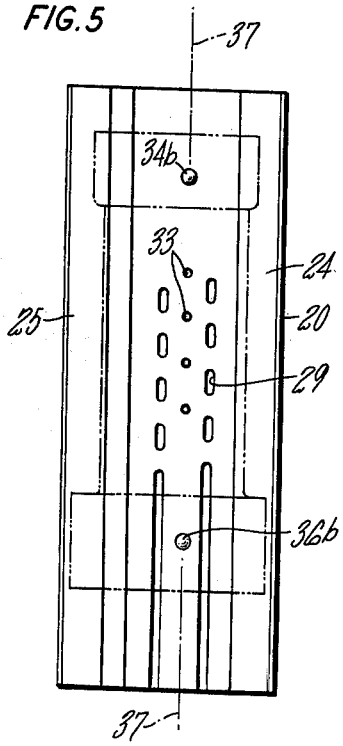

FIG. 6
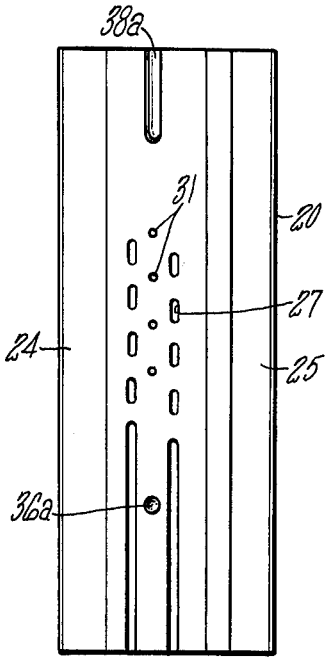
FIG. 7
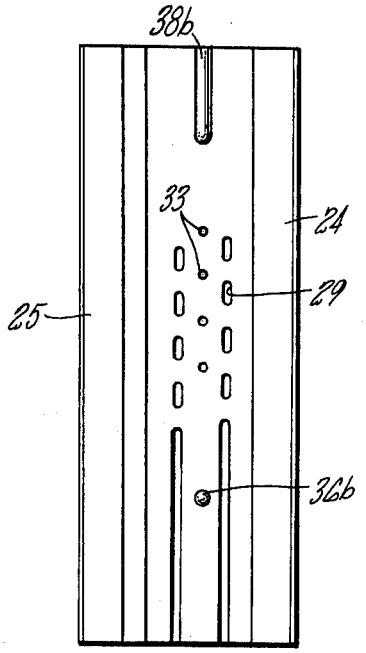
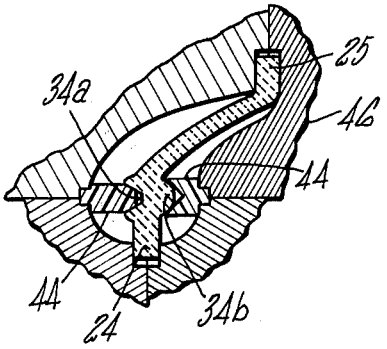
FIG. 8

METHOD FOR POSITIONING A STRONGBACK

BACKGROUND OF THE INVENTION

1. Field of the Invention

The present invention relates to a method for suspending a strongback in a pattern mold and ultimately in an investment mold for casting mating articles.

2. Description of the Prior Art

Copending patent application Ser. No. 499,227, now U.S. Pat. No. 3,981,344 entitled "Investment Casting Mold and Process" and assigned to the assignee of the present invention describes a method for making a cast product, such as a hollow gas turbine blade, wherein the product is cast in opposed, mating halves on opposite sides of a central mold element suspended rigidly in the mold cavity of an investment shell mold. The central mold element utilized in the disclosed process is referred to as a strongback and includes article-forming surfaces on opposite sides thereof and edge flanges extending beyond these surfaces to be embedded in the sheel mold. In making turbine blades and the like in accordance with the disclosed technique, the strongback is provided with bonding locators near the opposite ends of the article-forming surfaces. The locators may be in the form of a detent and mating projection on opposite sides of the strongback and are used to effect precision alignment of the blade halves for subsequent bonding. Such bonding locators are illustrated in the Hayes and Phipps patent, U.S. Pat. No. 3,965,963, with respect to a somewhat different casting process. As shown but not discussed in the patent, these locators are substantially colinear with the so-called design datum line of the turbine blade and strongback, which line is widely used as the reference line from which the blade and strongback structural features are measured and positioned.

In the casting process disclosed in the above-mentioned patent application, a critical step involves the attachment of wax patterns of the article halves to the opposite sides of the strongback. If the patterns are not attached in precise dimensional relationship to the strongback and to one another, the investment shell mold formed around the assembly will have a strongback incorrectly suspended therein, thus producing misoriented blade halves when molten metal is solidified therein. The most commonly used technique for pattern attachment involves suspending the strongback in the cavity of a pattern mold and injecting molten wax therein to form the patterns directly on each article-forming surface of the strongback. In this technique, locating means, such as knife edges, tabs and the like, are provided in the pattern mold to engage the outer edge periphery or perimeter of the strongback and locate it in proper relation in the cavity. However, this technique introduces error in positioning the strongback in several ways. First, the outer edge perimeter of the strongback is made within a definable tolerance range, such as ± .005 inch, and therefore varies in dimension from one strongback to the next. Location of the strongbacks with reference to such a variable outer perimeter thereby results in positional variations of the strongbacks, and bonding locators thereon, in the pattern mold. Second, the ceramic or refractory material from which the strongback is made exhibits shrinkage during various stages of the process. When the strongback is positioned with reference to its outer perimeter, the amount of shrinkage between the design datum line with which the bonding locators are substantially colinear and the outer perimeter is often-times significant and introduces another source for strongback positioning variations. Third, the locating means provided in the pattern mold for engagement with the outer perimeter must have dimensional and positional tolerances to accept the variable strongback perimeter. As a result, some strongbacks are not held as rigidly as others and have been known to shift position in the mold when the molten wax is injected therein under pressure. Of course, these strongback positioning errors lead to misoriented wax patterns and eventually in the production of investment molds having the strongback imprecisely suspended therein. Articles cast in such investment molds may exhibit significant dimensional variations, such as in the thickness of the turbine blade wall, which are cause for rejection of the casting. An equally detrimental result is that article halves cast in different investment molds cannot be satisfactorily mated and bonded together as a result of the imprecise dimensional relationship therebetween. In the mass production of articles, such as turbine blades, it is highly desirable, if not imperative, that turbine blade halves cast in different investment molds be capable of subsequent bonding one to any mating other to produce the finished blade.

Copending U.S. Pat. application Ser. No. 722,182 entitled "Strongback and Method for Positioning Same" of Walter T. Kelso and Frank T. Obrochta has a common assignee with the present invention and provides means for the improved positioning of a strongback in a pattern mold for formation of expendable, article-shaped patterns thereon. In one embodiment, a strongback having bonding locators near the opposite ends thereof is provided with additional locators to be used in suspending the strongback in the pattern mold. These pattern mold locators are colinear with and in close proximity to the bonding locators and are engaged by locating means in the pattern mold for establishing precise positioning of the strongback therein.

SUMMARY OF THE INVENTION

Accordingly, the present invention provides a method for the improved positioning of a strongback, such as a precast ceramic strongback, in a pattern mold for formation of expendable, article-shaped patterns thereon. Investment molds subsequently formed around the assembly of strongback and patterns are characterized as having the strongback precisely and reproducibly suspended therein.

The present invention typically utilizes a strongback having article-forming surfaces on opposite sides thereof and colinear bonding locators near the opposite ends of said surfaces. Expendable locating means are provided for suspending the strongback from the bonding locators in precise positional relationship in the pattern mold, the locating means being initially incorporated into the patterns formed on said surfaces and being subsequently removed, along with the patterns, after the investment mold is formed.

It is essential to the present invention that the locating means be incorporated into the patterns formed on the strongback, for otherwise holes would be produced in the patterns where the locating means engage the strongback. Of course, such holes cannot be tolerated in the patterns. The use of such locating means enables the bonding locators to also serve as locators for positioning the strongback in the pattern mold. Suspension of the strongback from the bonding locators essentially eliminates dimensional and other tolerances associated with the prior art technique of outer perimeter location and enables more precise and reproducible positioning of the strongback in relation to the pattern mold, to the patterns formed thereon and ultimately to the investment mold formed therearound than has heretofore been available. In addition, shifting of the strongback when pattern material is introduced into the mold is significantly reduced, if not eliminated, by utilizing locating means which intimately engage the bonding locators.

In a typical embodiment of the present invention, the strongback is suspended by high melting point wax pins which are precision molded to intimately engage the bonding locators and precisely position the strongback in the pattern mold cavity. Molten wax of a lower melting point is thereafter introduced to form patterns of the articles to be cast on the article-forming surfaces of the strongback, the wax locating pins being incorporated into the patterns as they solidify. In this way, the strongback can be suspended from the bonding locators without producing holes in the patterns. After the assembly of strongback and patterns is invested with ceramic slurry and particulate, the patterns and locating pins incorporated therein are readily removed by heating to the melting temperature of the locating pins to provide an investment mold having the strongback precisely suspended in the mold cavity thereof.

An important feature of the present invention is that such precise positioning can be reproduced among large numbers of strongbacks, since the bonding locators can be precision cast or molded into each strongback and since the expendable locating means can be similarly precision cast or molded. The present invention thus provides a method for making large numbers of investment molds having a strongback precisely suspended therein in substantially identical fashion. Articles cast in such molds will have mating surfaces in close dimensional relationship and can be bonded one to any mating other with the aid of the bonding locators to produce a finished product, regardless of whether the articles are cast in the same or in different molds.

These and other objects and advantages of the invention will appear more fully from the following description of the preferred embodiment.

BRIEF DESCRIPTION OF THE DRAWING

FIG. 1 is a plan view of the turbine blade to be produced.

FIG. 2 is a sectional view through the blade of FIG. 1.

FIG. 3 is a sectional view through a strongback with the patterns thereon in readiness for forming a shell mold.

FIG. 4 is a plan view of a side of the strongback.

FIG. 5 is a plan view of the opposite side of the strongback.

FIG. 6 is a plan view of a side of the strongback showing a modified bonding locator at one end.

FIG. 7 is a plan view of the opposite side of the strongback in FIG. 6.

FIG. 8 is a sectional view through the pattern mold with the strongback suspended therein.

DESCRIPTION OF THE PREFERRED EMBODIMENT

Although the exemplary embodiment set forth in detail below relates to the formation of investment molds having a strongback suspended therein for casting gas turbine blade halves, it is offered merely for illustration and is not intended to limit the scope of the present invention.

Referring to FIG. 1, the turbine blade to be produced is shown as including an airfoil portion 4, a root portion 6, and a shroud portion 8. The blade is hollow, FIG. 2, and has internal, opposed surfaces 10 and 12 having pedestals or ribs 13 projecting therefrom to define cooling air paths in the completed blade.

The teachings of copending U.S. application now U.S. Pat. No. 3,981,344 Ser. No. 499,227, described hereinbefore, will be followed to produce the blade by casting blade halves 18 and 19 on opposite sides of a central mold element or strongback. The strongback 20 utilized in the present invention is illustrated in FIGS. 3, 4 and 5 and has article-forming surfaces on opposite sides 21 and 22 thereof, these surfaces having the configuration of the internal surfaces 10 and 12 of the blade, including mating surfaces **10*a* and 12*a* and 10*b* and 12*b*. The strongback also has opposite edges extending beyond the article-forming surfaces to form side flanges 24 and 25 which become embedded in the investment shell mold. As shown most clearly in FIGS. 4 and 5, the article-forming surfaces (defined by the dotted lines) have appropriate slots 27 and 29 and recesses 31 and 33 to form ribs 13 in the cast blade halves. Since the ribs must cooperate on the opposed blade halves, the slots and recesses are in mirror relation to one another. The article-forming surfaces are also shown as having bonding locators 34*a*** and *b* and **36*a*** and *b* near the ends thereof colinear with the design datum line 37 determined for the blade. Each bonding locator is in the form of a detent and mating projection on opposite sides of the strongback and provides similar features, in reverse, on the cast blade halves for subsequent mating and bonding alignment. Of course, other forms of bonding locators may be utilized, including the embodiment of FIGS. 6 and 7 where at least one locator is in the form of a longitudinal ridge **38*a* and mating slot 38*b*** on opposite sides of the strongback to facilitate mating of the locators prior to the bonding operation.

In the practice of the present invention, the strongback is suspended in the cavity of a pattern mold by expendable locating means adapted to be initially incorporated into the patterns formed on the strongback and thereafter to be removed, along with the patterns, after the investment mold is formed. As shown in FIG. 8, the locating means may include rod-like locating pins 44 having ends adapted to intimately engage bonding locators **34*a*** and *b*, and similar pins (not shown) for engaging locators **36*a*** and *b*. However, those skilled in the art will recognize that other configurations of locating means are equally usable in the present invention. Regardless of the form chosen, the locating means must be precisely dimensioned and positioned in the pattern mold 46 (shown as a four part mold) so that upon engagement with the bonding locators, the strongback is precisely located and positioned in the mold cavity. In a preferred embodiment, the locating pins are made from wax having a melting point higher than that of the wax used to form the patterns on the strongback surfaces. For example, the locating pins may be made of a high melting point wax, such as one that melts at about 180° F, while the molten wax introduced into the pattern mold may have a lower melting point, such as 165° F. Wax is the preferred material for construction of the locating pins since it is inexpensive, readily molded or cast to the exact shapes and dimensions required and readily removable by melting. Those skilled in the art, however, will recognize that other materials, such as plastic, low melting point metals and alloys and the like may also be used. Proper positioning of the wax pins in the mold is achieved by inserting them in precisely machined holes in the mold walls, FIG. 8. After the strongback is precisely positioned, molten wax of low melting point is introduced into the pattern mold to form patterns 48*a* and *b* of the articles to be cast on the strongback surfaces 21 and 22, FIG. 3, the wax patterns having complementary and mating surfaces 50 and 52 and 51 and 53 corresponding to those to be provided on the cast blade halves. As the molten wax solidifies into the desired pattern shape, the locating pins of high melting point wax maintain the strongback in precise positional relationship in the pattern mold and eventually become incorporated into the solidified patterns. The strongback may thus be suspended from the bonding locators without formation of holes in the patterns. Therefore, it is essential in the present invention that the locating means become incorporated into the patterns formed on the strongback surfaces. The use of such locating means enables the bonding locators to also serve as locators for positioning the strongback in the pattern mold. The dimensional and other tolerances associated with the prior art technique of outer perimeter location are thereby effectively eliminated. In addition, the intimate engagement effected between the bonding locators and locating pins significantly reduces, if not eliminates, shifting of the strongback when the molten wax is injected into the pattern mold. As a result, positioning of the strongback will be significantly more precise than that available with the prior art technique of outer perimeter location. Since large numbers of strongbacks and locating means can be readily manufactured in accordance with the invention, reproducibility in the positioning of the strongbacks in the pattern mold is readily attained. As will be evident from the discussion below, this is highly advantageous in the mass production of turbine blades and other products.

The assembly of strongback and patterns thereon is then subjected to conventional and well-known investment shell mold formation operations, including successively and repeatedly dipping the assembly in ceramic slurry, stuccoing with dry ceramic particulate and drying until the desired thickness for a mold wall is obtained. The ceramic coated assembly is thereafter heated to melt out the wax patterns and wax locating pins incorporated therein and cure the ceramic coating into a strong mold to be used in casting. If desired, the patterns and pins may be removed in a separate heating step wherein the ceramic coated assembly is heated to the melting temperature of the locating pins. An investment mold having the strongback precisely suspended therein is thereby produced. Since large numbers of strongbacks having the bonding locators precisely disposed thereon can be readily manufactured and since each of these can be reproducibly suspended in the pattern mold for pattern attachment, large numbers of investment molds having the strongback precisely suspended therein in substantially identical fashion are now made available by the present invention. Blade halves or other articles cast in such investment molds, for example, by well-known processes, such as the directional solidification processes of U.S. Pat. Nos. 3,260,505; 3,494,709; and 3,793,010, will have mating surfaces in close dimensional relationship and can be bonded one to any mating other with the aid of the bonding locators to produce a finished blade, regardless of whether the blade halves are cast in the same or in different molds. In the mass production of blades for gas turbine engines, this feature of the present invention results in improved yields, lower production costs, and a better quality blade.

Although the preferred embodiment has been described above in relation to casting turbine blade halves, it will be readily understood by those skilled in the art that other articles can be cast with the aid of the present invention. Of course, the design datum line with which the bonding locators are substantially colinear will lie differently on different article shapes. However, this line may be readily calculated and determined by those skilled in the art for each shape. Those skilled in the art will also recognize that other changes, omissions and additions in the form and detail of the preferred embodiment may be made without departing from the spirit and scope of the present invention.

I claim

1. In making investment molds having a strongback suspended in the mold cavity thereof for casting articles having mating surfaces to be subsequently bonded together, wherein a strongback having bonding locators is first suspended in the cavity of a pattern mold for formation of expendable patterns of the articles thereon and then the assembly of strongback and patterns is surrounded by an investment mold, the improvement which comprises increasing the precision and reproducibility with which the strongback is positioned in the investment molds, including:

suspending the strongback in the pattern mold by expendable locating means adapted to engage the bonding locators, the locating means being initially incorporated into the patterns as they are formed and being subsequently removed, along with the patterns, after the investment mold is formed, the incorporation of the locating means into the patterns enabling the bonding locators to also serve as locators for positioning the strongback in the pattern mold, thereby eliminating dimensional and other tolerances between such locators and improving the precision and reproducibility with which the strongback is positioned in relation to the pattern mold, to the patterns formed thereon and consequently to the investment mold ultimately formed therearound.

2. The method of claim 1 wherein the patterns are formed by introducing molten material into the pattern mold cavity while the strongback is suspended therein by locating means made of a material having a melting point higher than the molten material, the locating means being incorporated into the patterns as they solidify and being subsequently removed, along with the patterns, by heating to the higher melting point.

3. The method of claim 2 wherein the patterns and locating means are formed of waxes having different melting points.

4. The method of claim 1 wherein the locating means are rod-like pins having ends adapted to intimately engage the bonding locators.

5. The method of claim 1 wherein one bonding locator includes a detent and mating projection on opposite sides of the strongback and the other includes a longitudinal slot and mating ridge on opposite sides of the strongback to facilitate bonding alignment.

* * * * *